US008819984B2

(12) United States Patent
Borkowski et al.

(10) Patent No.: US 8,819,984 B2
(45) Date of Patent: Sep. 2, 2014

(54) FIREARM STABILIZATION APPARATUS

(71) Applicant: Asymmetric Technologies, LLC, Columbus, OH (US)

(72) Inventors: Brian Borkowski, Columbus, OH (US); Michael Cress-Holton Clanton, Culleoka, TN (US)

(73) Assignee: Asymmetric Technologies, LLC, Columbus, OH (US)

( * ) Notice: Subject to any disclaimer, the term of this patent is extended or adjusted under 35 U.S.C. 154(b) by 0 days.

(21) Appl. No.: 13/930,933

(22) Filed: Jun. 28, 2013

(65) Prior Publication Data

US 2014/0075819 A1 Mar. 20, 2014

Related U.S. Application Data

(63) Continuation-in-part of application No. 12/631,395, filed on Dec. 4, 2009, now Pat. No. 8,484,878.

(51) Int. Cl.

| | |
|---|---|
| ***F41C 27/00*** | (2006.01) |
| ***F41C 33/00*** | (2006.01) |
| ***F41A 23/02*** | (2006.01) |
| ***F41C 23/20*** | (2006.01) |

(52) U.S. Cl.

CPC ..... *F41A 23/02* (2013.01); *F41C 33/001* (2013.01); *F41C 23/20* (2013.01)

USPC ..... 42/94; 2/2.5; 2/459; 2/461; 2/462; 2/463; 2/464; 2/465; 89/36.05; 42/99

(58) Field of Classification Search

USPC ..... 42/94, 99; 89/36.02–36.12; 2/2.5, 2/459–465

See application file for complete search history.

(56) References Cited

U.S. PATENT DOCUMENTS

| | | | | |
|---|---|---|---|---|
| 3,041,938 | A * | 7/1962 | Seabrook | 89/37.04 |
| 3,178,784 | A * | 4/1965 | Charles | 24/10 R |
| 3,257,666 | A * | 6/1966 | Hoffman | 2/459 |
| 3,504,377 | A | 4/1970 | Biggs et al. | |
| 3,935,657 | A * | 2/1976 | Wade | 42/94 |
| 4,353,133 | A | 10/1982 | Williams | |
| 4,493,115 | A * | 1/1985 | Maier et al. | 2/459 |
| 4,514,862 | A | 5/1985 | A'Costa | |
| 4,610,034 | A | 9/1986 | Johnson | |
| 4,642,815 | A | 2/1987 | Allen | |
| 4,669,125 | A | 6/1987 | Allen | |
| 5,431,318 | A | 7/1995 | Garcia | |
| 5,590,826 | A | 1/1997 | Endo | |

(Continued)

OTHER PUBLICATIONS

"UK Releases New Helmet and Armor," Soldier Systems an Industry Daily [online], available Jun. 27, 2009 [retrieved on Mar. 4, 2010].

(Continued)

*Primary Examiner* — Samir Abdosh

(74) *Attorney, Agent, or Firm* — Frank M. Caprio; Jeremy A. Smith; Bradley Arant Boult Cummings LLP

(57) ABSTRACT

The present disclosure provides a firearm stabilization apparatus having (1) a main body further having a stopped dado which forms a depression on a front surface of the main body; a first magnet positioned within the depression; a slot along a edge of the main body; and a second magnet positioned within the slot; and (2) a firearm further with a third magnet.

7 Claims, 12 Drawing Sheets

(56) References Cited

U.S. PATENT DOCUMENTS

| | | | | |
|---|---|---|---|---|
| 5,867,842 | A * | 2/1999 | Pinsley et al. | 2/462 |
| 5,937,559 | A * | 8/1999 | Jennen | 42/94 |
| 6,163,889 | A * | 12/2000 | Tate | 2/209.13 |
| 6,588,023 | B1 | 7/2003 | Wright | |
| 6,601,742 | B2 * | 8/2003 | Hickman | 224/149 |
| D522,214 | S | 6/2006 | Noell | |
| 7,380,487 | B2 * | 6/2008 | Mantras | 89/42.01 |
| 7,424,748 | B1 | 9/2008 | McDunn et al. | |
| 7,434,301 | B1 | 10/2008 | Johnson | |
| 7,520,206 | B2 | 4/2009 | Baker | |
| 7,817,002 | B2 * | 10/2010 | Fullerton et al. | 335/306 |
| 7,821,367 | B2 * | 10/2010 | Fullerton et al. | 335/306 |
| 8,210,088 | B1 * | 7/2012 | Keyfauver | 89/36.05 |
| 2003/0110933 | A1 | 6/2003 | Baker | |
| 2010/0005555 | A1 | 1/2010 | Osborne | |
| 2010/0269234 | A1 | 10/2010 | Bennett | |
| 2011/0055992 | A1 | 3/2011 | Roux | |
| 2011/0072545 | A1 | 3/2011 | Bennett | |
| 2011/0072546 | A1 | 3/2011 | Taylor et al. | |
| 2011/0072565 | A1 | 3/2011 | Krueger | |
| 2011/0093996 | A1 | 4/2011 | Henriquez | |
| 2011/0113520 | A1 | 5/2011 | Dennis | |
| 2011/0145965 | A1 | 6/2011 | Hirano | |
| 2011/0209260 | A1 | 9/2011 | Herbener et al. | |
| 2011/0214212 | A1 | 9/2011 | Marx et al. | |
| 2012/0137560 | A1 * | 6/2012 | Denton et al. | 42/71.01 |
| 2012/0158041 | A1 * | 6/2012 | Craig | 606/203 |
| 2013/0254976 | A1 * | 10/2013 | Aravena | 2/300 |

OTHER PUBLICATIONS

Retrieved from Soldier Systems website using Internet <URL: http://soldiersystems.net/2009/06/27/uk-releases-new-helmet-and-armor/>.

* cited by examiner

FIREARM STABILIZATION APPARATUS

CROSS REFERENCE TO RELATED APPLICATIONS

This application is a continuation-in-part of and therefore claims priority to, and the benefit of, currently pending U.S. patent application Ser. No. 12/631,395 filed Dec. 4, 2009 entitled. "Firearm Stabliziation Apparatus."

FIELD OF THE DISCLOSURE

The present disclosure relates to a firearm stabilization apparatus. The present disclosure further relates to a firearm stabilization apparatus which allows a user to properly seat the firearm in their shoulder pocket while wearing body armor. In one embodiment, the firearm stabilization apparatus is reversibly attached to body armor. In an alternate embodiment, the firearm stabilization apparatus is integrated into the left or right shoulder regions of the body armor.

BACKGROUND

Body armor (also known as a bullet proof vest) is protective gear designed to stop projectiles including bullets and shrapnel. Body armor is used by police, military personnel and private security services. Generally there are two distinct groups of body armors: body armors that used are by police officers, and body armors that are used by the military or other high risk groups, such as the Secret Service.

Among the first group, there are different types of body armor characterized by increasing protection power. Generally, Type I body armor protects against .22 long rifle lead round nose bullets, with nominal masses of 2.6 g, impacting at a minimum velocity of 320 m/s or less. Type II body armor protects against 9 mm full metal jacketed round nose bullets, with nominal masses of 8.0 g, impacting at a minimum velocity of 332 m/s or less. Type III body armor protects against 9 mm full metal jacketed round nose bullets, with nominal masses of 8.0 g, impacting at a minimum velocity of 427 m/s or less. Finally, Type IV body armor protects against .30 caliber armor piercing (AP) bullets (U.S. military designation M2 AP), with nominal masses of 10.8 g (166 gr), impacting at a minimum velocity of 869 m/s (2850 ft/s) or less, It also provides at least single-hit protection against the Type I through III threats. Type I-IV armors are often soft armors.

Body armors for high risk groups (military personnel for example) are, at the moment, not soft armors. One example of body armor used by the Army is the the Improved Outer Tactical Vest (IOTV) 34 which replaced the older Interceptor body armor. The IOTV, as shown in FIGS. 1 and 2, includes a front protector 42, a back protector 44 and optionally includes neck protectors 40 and/or side protectors 46. A soldier may don the IOTV in two ways. The first is to simply place the IOTV over the head and pull down, and the second is to remove fasteners on the soldier's left shoulder, sliding into the vest to the right. To complete the procedure for both methods, the soldier then lifts up the front panel of the vest and fastens a waistband, which takes the weight of the IOTV off the shoulders somewhat, and then fastens the side protection modules. A key design feature for the IOTV is that the entire system is able to be released with the pull of a hidden lanyard. The armor then falls apart into its component pieces, providing a means for escape in case the soldier falls into water or becomes trapped in a hazardous environment. The hidden release lanyard also allows medical personnel easier access to an injured soldier, which was one concern that was not addressed with the old Interceptor armor.

The IOTV is designed to take the weight of the vest off the shoulders and move it to the lower torso. The IOTV may also be equipped with a mesh inner cover that is designed to improve airflow inside of the armor. There is also a back pad in the lower back area of the vest, which is designed to defeat fragmentation impacts to the lower back/kidney areas. The IOTV can withstand a direct impact from a 7.62 millimeter (both NATO and ex-Soviet types) on the front or rear trauma plates. The IOTV provides, without the ballistic ceramic plates inserted, protection from small caliber rounds (i.e. 9 mm) and fragmentation, much the same as the fragmentation vest or "flak jacket" used since the Vietnam Conflict.

One shortcoming of the IOTV, and most other body armors, is the inability to correctly position and stabilize a firearm. Still referring to FIGS. 1 and 2, the right and left shoulder regions 36, 38 and bulky and cumbersome. The Army Field Manual teaches that soldiers should position the butt of their firearm (such as an M16 or M4) in the crease between their shoulder and chest (the so called "pocket"). Further, military patrols are taught to maintain their firearms in the firing position for quick and responsive firing on patrol. The present invention provides a firearm stabilization pad that allows the user to seat the firearm in the shoulder pocket correctly.

BRIEF DESCRIPTION OF THE DRAWINGS

To further advantages and features of the present disclosure, a more particular description of the invention will be rendered by reference to specific embodiments thereof which are illustrated in the appended drawings. It is appreciated that these drawings are not to be considered limiting in scope. The invention will be described and explained with additional specificity and detail through the use of the accompanying drawings in which.

SUMMARY

Figure 1:
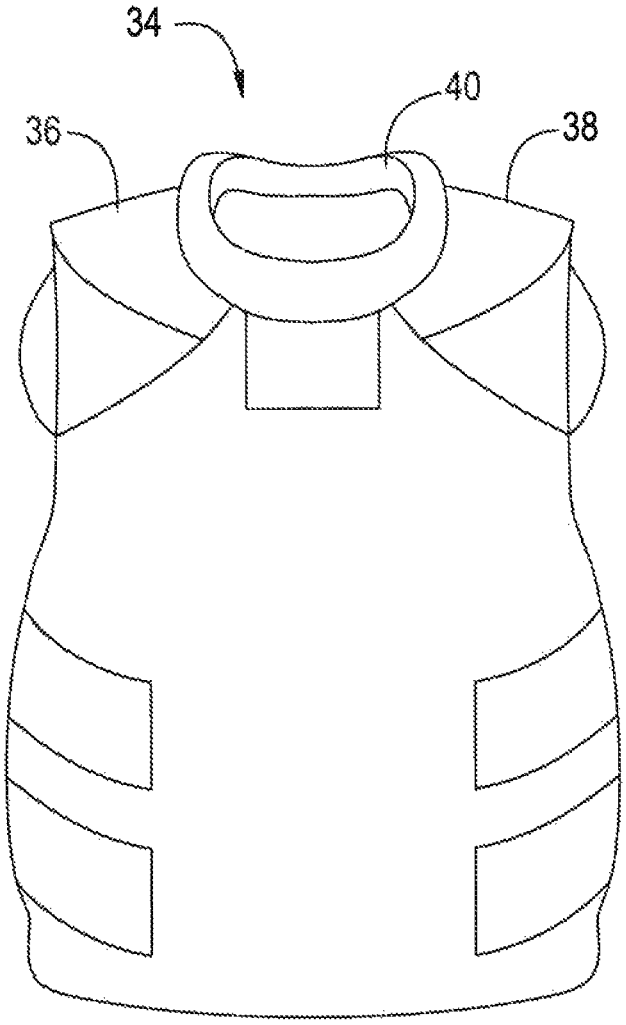
FIG. 1 Prior Art
FIG. 1 shows one embodiment of a prior art IOTV.
Figure 2:
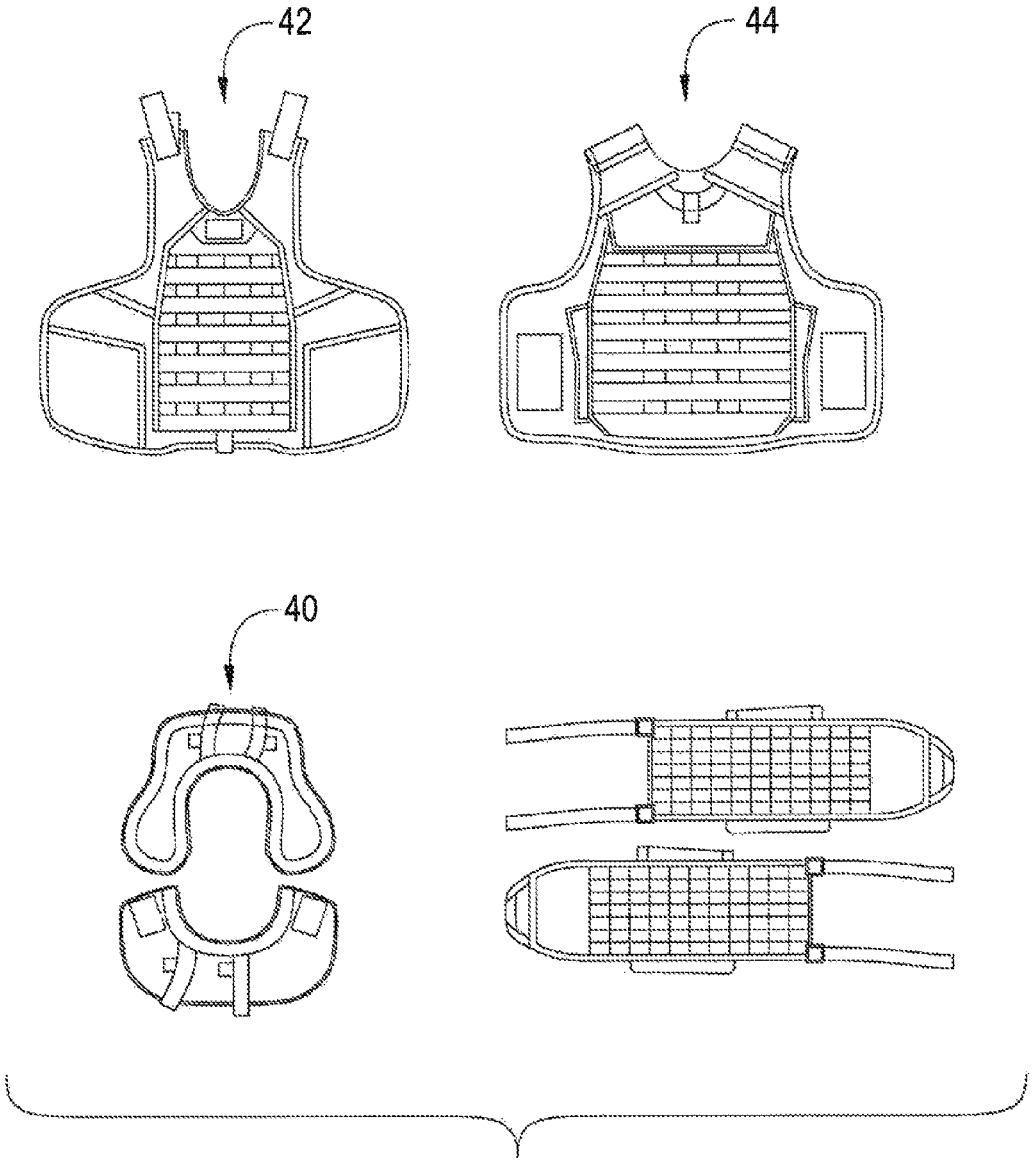
FIG. 2 Prior Art
FIG. 2 shows the various components of one embodiment of a prior art IOTV.

The present disclosure provides, in one embodiment, a firearm stabilization apparatus that provides a stable location on the user ready to receive the butt stock of a rifle so that it is seated in the proper firing position.

DETAILED DESCRIPTION

The present disclosure provides a firearm stabilization apparatus 2 which allows a user wearing body armor to position and stabilize a firearm in the proper position (i.e., the shoulder pocket) for accurate firing.

In one embodiment the firearm stabilization apparatus 2 includes a front portion 4, a back portion 22 and at least one connector 20 and reversibly attaches to a body armor 34.

Figure 3:
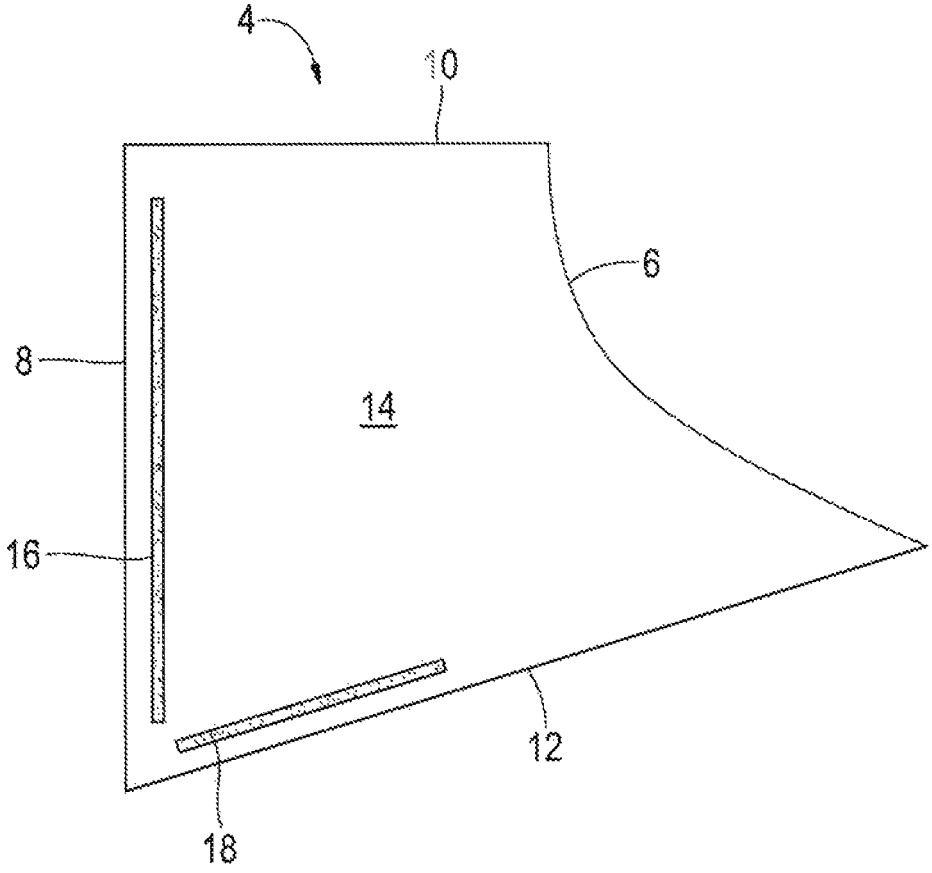
FIG. 3 shows one embodiment of the front portion of the firearm stabilization apparatus.
Figure 4:
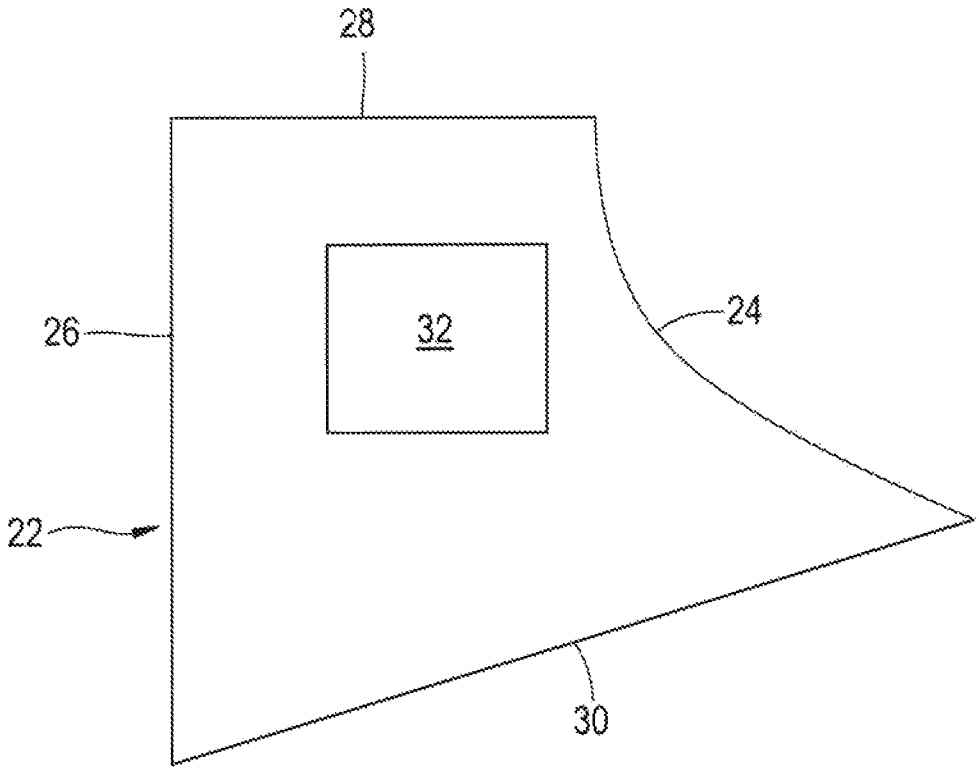
FIG. 4 shows one embodiment of the back portion of the firearm stabilization apparatus.
Figure 5:
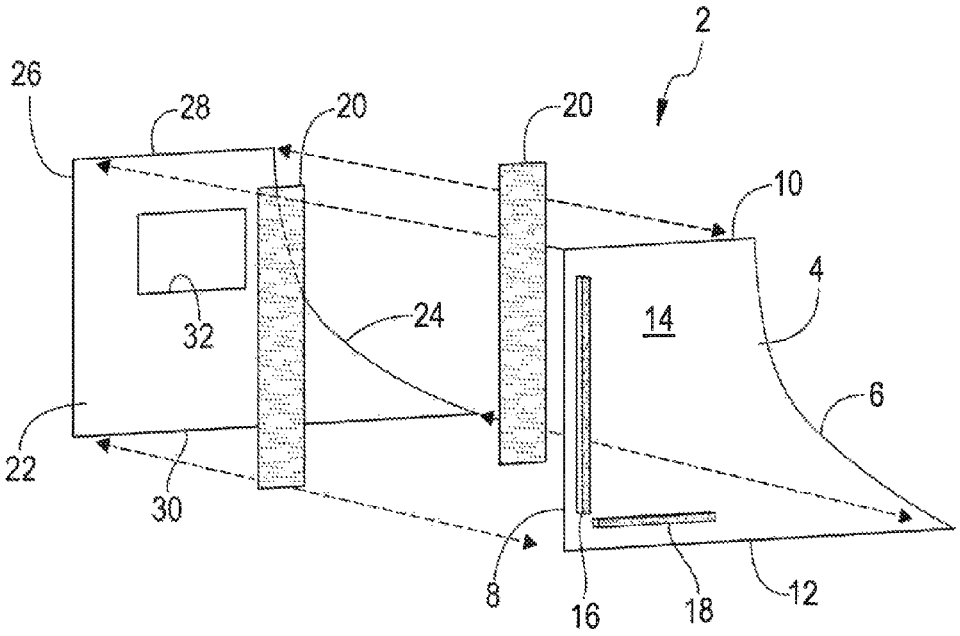
FIG. 5 shows one embodiment of a fully assembled firearm stabilization apparatus.
Figure 6:
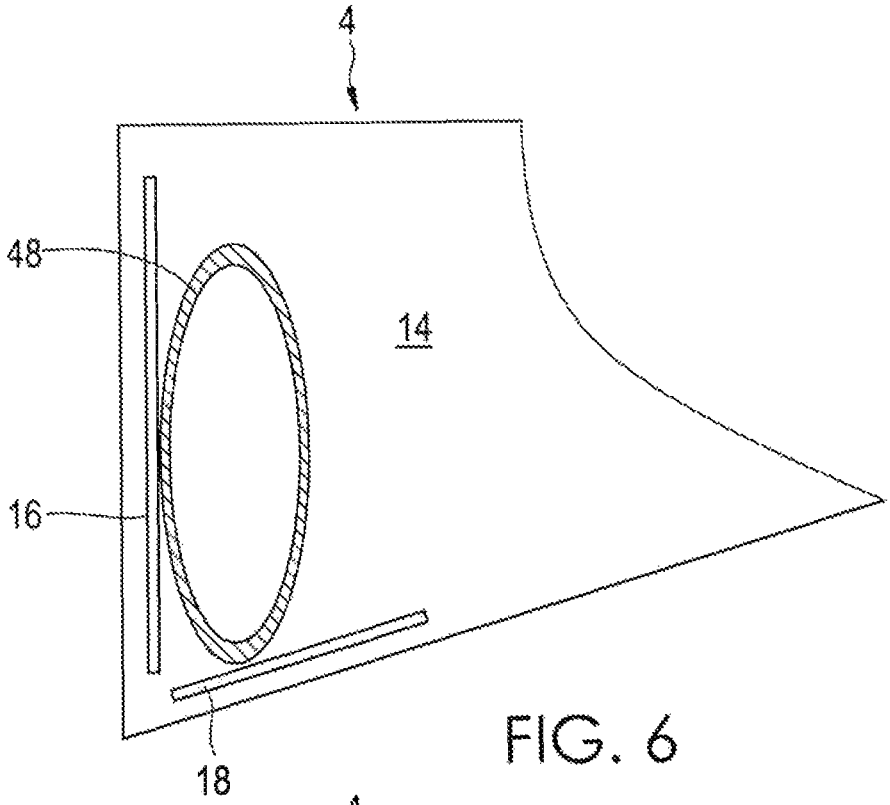
FIG. 6 shows one embodiment of the firearm stabilization apparatus receiving the butt end of a firearm.
Figure 7:
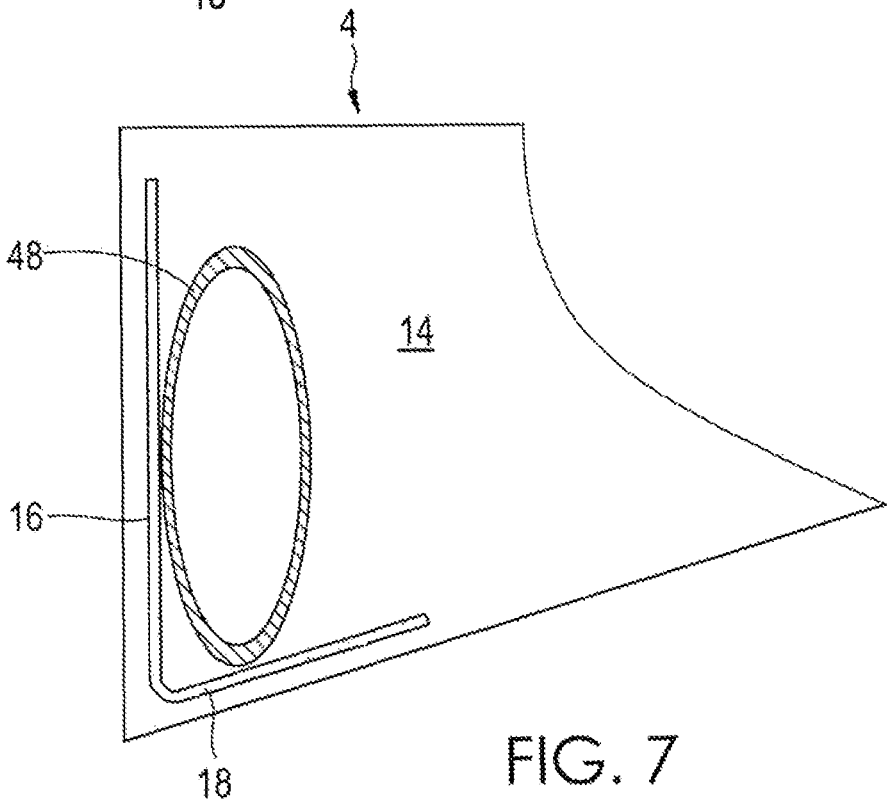
FIG. 7 shows an alternate embodiment of the firearm stabilization apparatus receiving the butt end of a firearm.

In one embodiment shown in FIGS. 3-6, the front portion 4 is a quadrilateral and includes a curved medial side 6, a lateral side 8, an upper potion 10, a lower potion 12 and a front panel 14. In one embodiment, the upper portion 10 also includes a medial and a lateral segment where the lateral segment intersects with the lateral side 8 of the firearm stabilization apparatus 2 in a nearly perpendicular manner forming a right angle. In a further embodiment, the lower portion 12 likewise comprises a medial and a lateral segment where the lateral segment of the lower portion 12 intersects the lateral side 8 of the firearm stabilization apparatus 2 to form an acute angle. The medial segments of the lower portion 12 and the upper portion 10 then intersect with the curved medial side 4 of the firearm stabilization apparatus 2. Generally, as shown in FIG. 3, the upper portion 10 will be shorter than the lower portion 12 thereby allowing the curved medial side 4 and lower portion to form an angle or point where they intersect and creating a curve towards the intersection of the upper portion 10 and the curved medial side 6. In one embodiment the curve mimics or follows the curvature of the head/neck opening of body armor. In a further embodiment, the curve mimics or follows the curvature of the head/neck opening of the IOTV. In one embodiment, as shown in FIGS. 3-5, the lower portion 12 is a straight line from its intersection with the lateral side 6 and the curved medial side 4. In other embodiments (not shown) the lower portion 12 may include one or more steps or angles in the space from its intersection with the lateral side 6 and the curved medial side 4.

The front portion 4 also includes at least one stabilizing element on the front panel 14 which stabilizes the butt of a firearm in the vertical orientation, the horizontal orientation or both (as shown in FIG. 3). In a preferred embodiment shown in FIG. 3, the stabilizing element on the front portion 4 includes a horizontal stabilizing brace 16 and a vertical stabilizing brace 14. The horizontal stabilizing brace 16 serves to prevent the butt of a firearm from moving in the vertical axis while the vertical stabilizing brace 18 serves to prevent the butt of the firearm from moving along the horizontal axis, in other embodiments, the front portion 4 may only include a horizontal stabilizing brace 16 or a vertical stabilizing brace 18. In further embodiment, the horizontal stabilizing brace 16 and vertical stabilizing brace 18 are one contiguous piece of material that extends a distance along the lateral side 8 and the lower portion 12. The stabilization element may generally be located closer to the lateral side 8 of the firearm stabilization apparatus 2 than the curved medial side 6 to allow the user to place the firearm's butt in the user's shoulder pocket.

In one embodiment the horizontal stabilizing brace 16 and a vertical stabilizing brace 18 are approximately 0.25 inches in height (i.e., the top of the braces is approximately 0.25 inches from the front portion 4), although other heights are acceptable and should be considered within the scope of this disclosure. In one embodiment, the horizontal stabilizing brace 16 and a vertical stabilizing brace 18 are different heights. In one preferred embodiment, the horizontal stabilizing brace 16 includes two (2) different segments, a first longer second segment and a second, shorter segment. The first longer segment measures approximately 6.00 inches long, 0.50 inches in width and 0.75 inches in height. The second shorter segment measures approximately 0.50 inches in length, 0.50 inches in width and 0.50 inches in height. In this preferred embodiment, the vertical stabilization brace 18 also includes two (2) segments, a first connecting segment and a second angled segment. The first connecting segment connects to both the angled segment and the second shorter segment of the horizontal stabilizing brace 16 and measures approximately 1.50 inches in length, 0.50 inches in height and 0.50 inches in width. The second angled segment intersects the first connecting piece to form an angle of approximately 40 degrees and measures approximately 1.25 inches long, 0.50 inches in height and 0.50 inches in width. In one embodiment the braces are made from rubber (natural or synthetic), although other materials known in the art are to be considered within the scope of this disclosure.

In one embodiment, the back portion 22, as shown in FIG. 4, is substantially a mirror image of the front portion 4 (without the horizontal stabilizing brace 16 and vertical stabilizing brace 18) and has a curved medial side 24, a lateral side 26, an upper portion 28 and a lower portion 30. In one embodiment the back portion includes a shoulder strap passage 32 which allows the user to place the firearm stabilization apparatus 2 on body armor (as described in more detail below) and allows the body armor to be donned in a normal manner. In one embodiment the shoulder strap passage 32 is a square with sides that are approximately 0.75 inches in length, though other shaped and sized shoulder strap passage may be required for different body armor. In this embodiment the shoulder strap passage 32 receives the quick release shoulder straps of the IOTV. In the embodiment Where the firearm stabilization apparatus 2 is attached to the IOTV, the shoulder strap passage 32 should be of sufficient size, whether it is a square or other shape, to allow the quick release shoulder straps of the IOTV to function properly. The quick release features of the IOTV are important in that they allow the user to get out of the IOTV quickly when needed such as when a military vehicle rolls over into water and helps medics to treat the injured or wounded quicker.

In an alternate embodiment, the firearm stabilization apparatus 2 includes a front portion 4 as described above and shown in FIG. 3 and a back panel 15 (not shown). In one further embodiment, the firearm stabilization apparatus 2 may be reversibly attached to body armor through various means. In one further embodiment the back panel 15 and the body armor have corresponding hook-and-loop fasteners (or Velcro) whereby the firearm stabilization apparatus 2 is attached to body armor. In one embodiment the body armor is the IOTV. In yet an alternate embodiment, the firearm stabilization apparatus 2 is permanently attached to the body armor, preferably to the left, right or both shoulder regions. The permanent attachment could be by any method known including sewing, gluing or both.

FIG. 5 shows the general assembly of the firearm stabilization apparatus 2 which includes the front portion 4 and back portion 22 is shown using the connectors 20. In one embodiment the connectors are hook-and-loop fasteners although other embodiments such as nylon webbing, cloth webbing, elastic webbing and other means known to those of skill in the art are to be considered within the scope of this disclosure.

To assemble this embodiment of the firearm stabilization apparatus 2, the back portion 22 and front portion 4 are placed around the shoulder strap 33 of the body armor 34. The back portion 22 should be placed between the shoulder strap 33 and the user while the front portion 4 should be placed in an outward facing direction over the shoulder strap 33 with the stabilizing braces facing outward as well. Then the front portion 4 and rear portions 22 are joined together through the connectors (such as the hook and loop fasteners). In an alternate embodiment the firearm stabilization apparatus 2 is attached to the body armor 34 by simply sliding it over the shoulder strap 33. In both of the prior embodiments the shoulder strap 33 will be passed through the shoulder strap passage 32 on the back portion 22. The body armor 34 then may be worn in a normal manner.

The firearm stabilization apparatus 2 may be constructed from any suitable material. In one embodiment, the firearm stabilization apparatus 2 is constructed from standard Army Combat Uniform Material ("ACU" material). In other embodiments the firearm stabilization apparatus 2 is constructed from material similar to the pattern and material of the body armor on which it is placed. By way of non-limiting example, if the firearm stabilization apparatus 2 is to be used with a black body armor, the firearm stabilization apparatus 2 may be constructed from a black material.

In some embodiments, the front portion 4 may include a non-slip surface which further helps stabilize the firearm. The non-slip surface may include rubber (natural or synthetic) or siliconized compounds.

In one embodiment as shown in FIGS. 1-6, the firearm stabilization apparatus 2 is designed to be worn with the IOTV. In other embodiments, the firearm stabilization apparatus 2 may be worn with the Marine Modern Tactical Vest (MTV), Improved Ballistic Armor (IBA) or soft armors constructed from Kevlar® Kevlar 29®. Kevlar Protera® (all available from E. I. du Pont de Nemours), Spectra® fiber (available from Allied Signal), Gold Shield® (also available from Allied Signal), TWARON® (available from Akzo Nobel) or Dragon Skin® Armor (available from Pinnacle Armor). Of course, the firearm stabilization apparatus 2 may adapted for use with future body armors as well including without limitation the Soldier Plate Carrier® (available from KDH Defense Systems), the Rampage, and the Coyote Chameleon® Tactical Vest (available from ArchAngel, Inc.)

The dimensions of the firearm stabilization apparatus 2 may be altered to coincide with different sizes of body armor. Typically, body armor may come in a small, medium, large or extra-large size and the overall dimensions of the firearm stabilization apparatus 2 may be altered to provide the correct fit with a certain size of body armor. In one embodiment, to correctly fit and function with a size large IOTV, the lateral side 8 is approximately 9.00 inches in length, the upper portion 10 is approximately 3.00 inches in length and the lower portion 12 is approximately 6.00 inches in length. The dimensions of the back portion 22 may substantially mirror the dimensions of the front portion 4. In further embodiments, the dimensions of the firearm stabilization apparatus 2 may be altered to fit different types of body armor, by way of non-limiting example, a firearm stabilization apparatus 2 that fits a large size MTV may be of different dimensions than one that fits a large size Marine MTV.

In an alternate embodiment as shown in FIGS. 8-21, the firearm stabilization apparatus 2 comprises a main body 50 and an anchor 52. In yet another embodiment, the firearm stabilization apparatus 2 comprises a main body 50.

Figure 8:
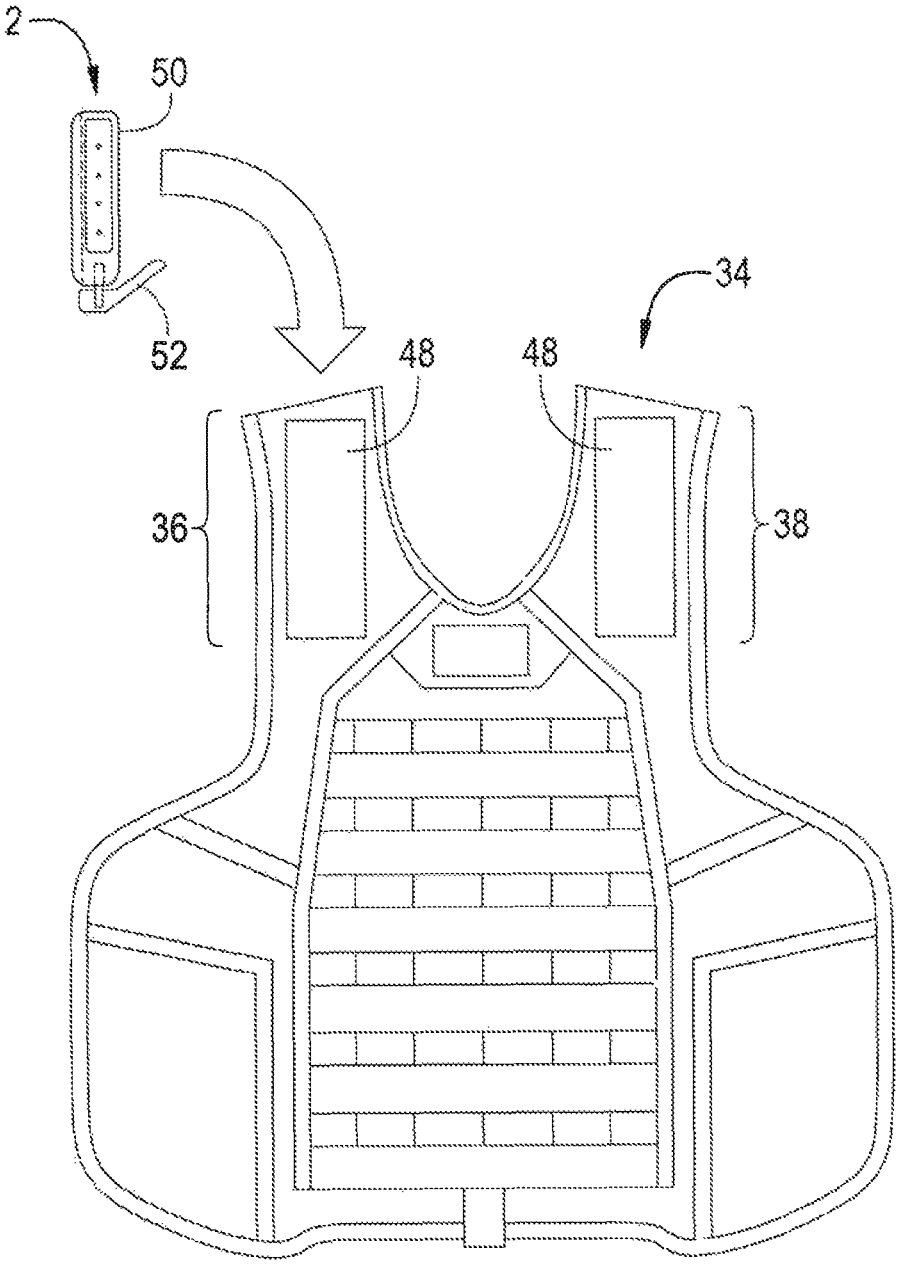
FIG. 8 shows an alternate embodiment of the firearm stabilization apparatus being positioned inside of a pocket of a tactical vest.
Figure 9:
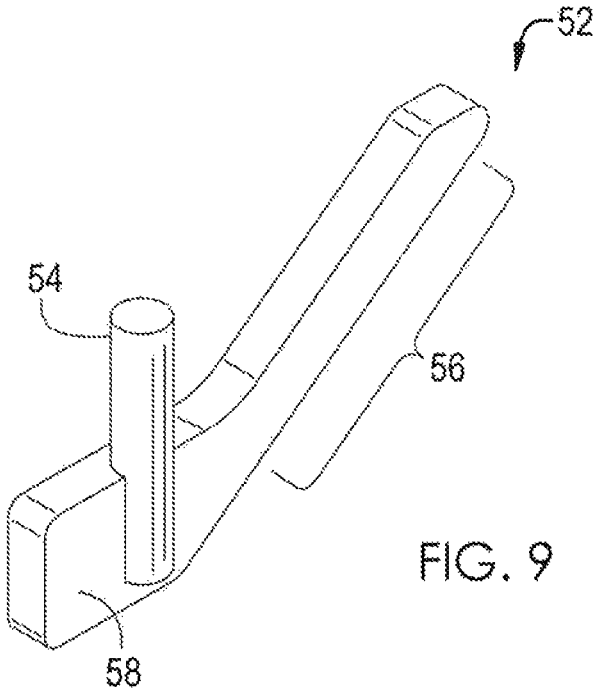
FIG. 9 shows a perspective view of one embodiment of an anchor of the firearm stabilization apparatus.
Figure 10:
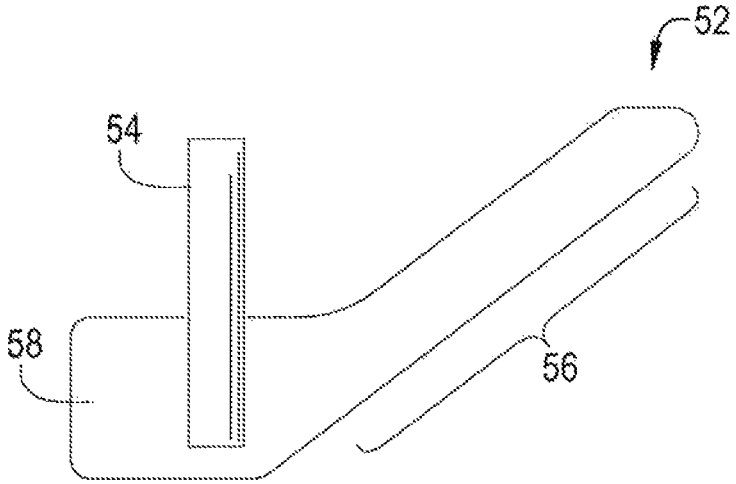
FIG. 10 shows a side view of one embodiment of an anchor of the firearm stabilization apparatus.
Figure 11:
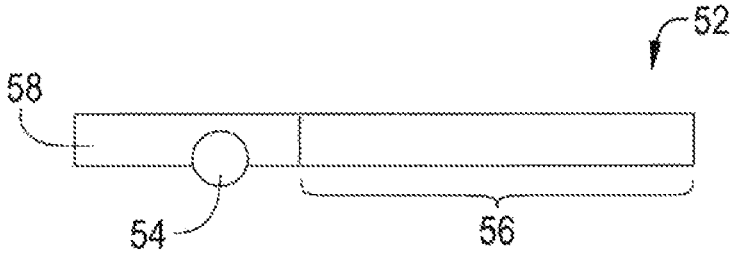
FIG. 11 shows a top view of one embodiment of an anchor of the firearm stabilization apparatus.
Figures 12, 13, 14, 15, 16, 17:
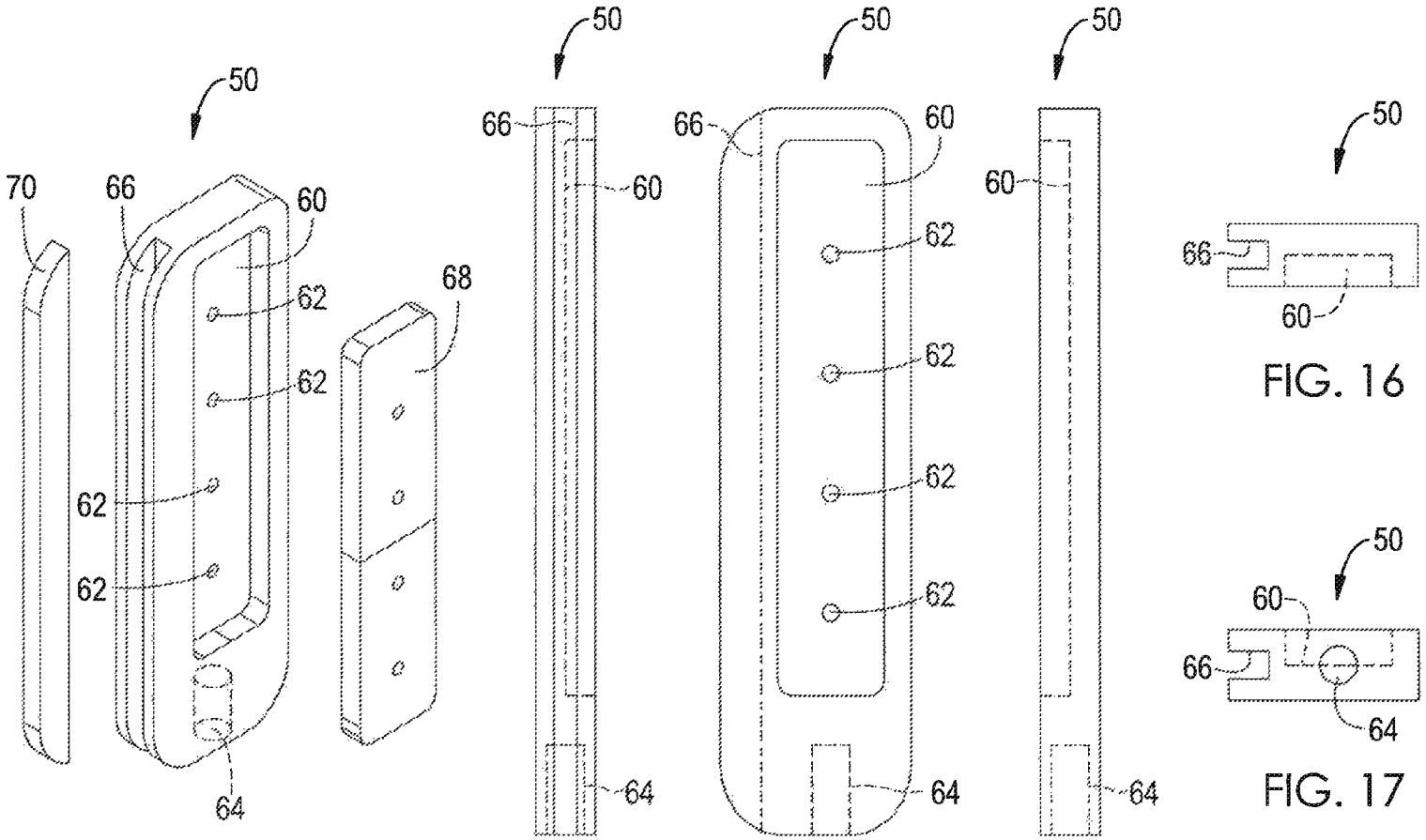
FIG. 12 shows a perspective view of one embodiment of a main body of the firearm stabilization apparatus.
FIG. 13 shows a side view of one embodiment of a main body of the firearm stabilization apparatus.
FIG. 14 shows a front view of one embodiment of a main body of the firearm stabilization apparatus.
FIG. 15 shows an alternate side view of one embodiment of a main body of the firearm stabilization apparatus.
FIG. 16 shows a top view of one embodiment of a main body of the firearm stabilization apparatus.
FIG. 17 shows a bottom view of one embodiment of a main body of the firearm stabilization apparatus.

Now referring to FIGS. 8 and 9, the anchor 52 further comprises a spindle 54, an arm 56 and a anchor body 58. The anchor 52 is configured to securely and effectively position the firearm stabilization apparatus 2 in place while in use.

The spindle 54 contacts the anchor body 56 on one end of the spindle 54 and extends generally upwardly therefrom. In one embodiment, spindle 54 is affixed to the anchor body 56 via glue or epoxy, of course, other means of fastening or attaching the spindle 54 to the anchor body 56 that provide sufficient resiliency for proper operation should be considered within the scope of this embodiment.

The arm 56 extends in a generally latitudinal direction from the anchor body 58 as shown in FIGS. 8 and 9. The arm 56 (as described below) is the principle mechanism that serves to securely position the anchor 52 relative the body armor 34. In one embodiment, the arm 56 and the anchor body 58 comprise an integrally formed construction.

In the embodiment shown in FIGS. 8 and 9, the anchor 52 is configured to be positioned in the pocket 48 of the body armor 34. Specifically, the anchor 52 may be inserted into the pocket 48 by turning the anchor 52 such that the arm 56 is parallel to the longitudinal axis of the pocket 48 and lowering the anchor 52 into the pocket 48. When the arm 56 contacts the bottom of the pocket 48, the anchor 52 is rotated such that the arm 56 is positioned towards the medial line of the vest 34 (and thus the wearer's body). The anchor 52 is rotated until the bottom of the anchor 53 comes is proximate to the bottom of the pocket 48. The rotation of the anchor 52 positions the arm 56 in such position as to effectively secure the anchor 52 in place in the pocket 48. After the anchor 52 is positioned into the pocket 48, the main body 50 of the firearm stabilization apparatus 2 may be lowered onto the spindle 54. The main body 50 is freely rotatable about the spindle 54.

Now referring to FIGS. 12-17, in one embodiment, the main body 50 comprises a stopped dado 60 on its front surface, one or more screw holes 64 inside of the stopped dada 60, a spindle receiving opening 64 and a slot 66.

The stopped dado 60 creates a depression or recess on the front surface of the main body 50 in which a first magnet 68 is placed. Generally, it is desirable that the shape and size of the depression created by the stopped dado 60 mirrors the size and dimension of the first magnet 68. The first magnet 68 may be secured to the main body 50 via one or more screws (or other fasteners) which inserts into the one or more screw holes 64. Alternatively, the first magnet 68 may be affixed to the main body 50 via a glue or other mechanism without the use of screws.

The main body 50 further comprises a spindle receiving opening 64 located below the stopped dado 60. As described above, the spindle receiving opening 64 receives the spindle 54 of the anchor 52, as such the spindle receiving opening 64 should be of sufficient diameter and depth to receive the spindle 54.

The main body 50 also comprises a slot 66 on a first edge. The slot is configured to receive a second magnet 70. The slot 66 may of sufficient depth such that it is in fluid communication with the depression created by the stopped dado 60. In one embodiment, the first edge of the first magnet 68 and the first edge of the second magnet 70 attract one another along such that the attraction serves to hold the second magnet 70 in place in the slot 66. The slot 66 may extend the length of the main body 50 or it may extend only a portion of the length of the main body 50.

In one embodiment, the main body 50 is configured to fit within the pocket 48 of the vest 34 as described herein. In an alternate embodiment, the main body 50 may be sewn into or included with the vest during manufacture. Accordingly, it should be considered within the scope of this disclosure to provide a firearm stabilization apparatus 2 comprising only the main body 50 as described above (without the spindle receiving opening 64).

Figure 18:
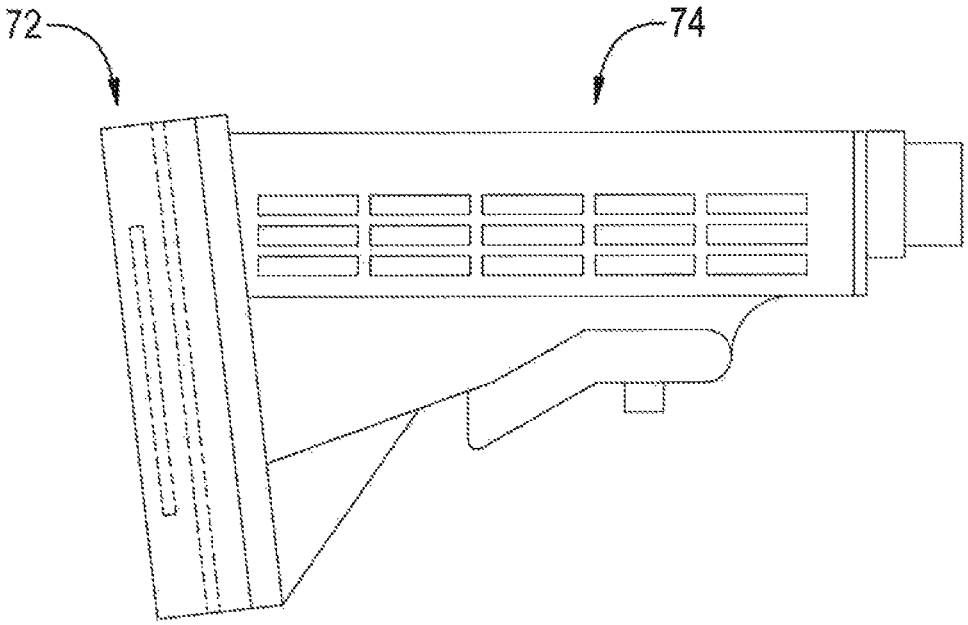
FIG. 18 shows a side view of a firearm comprising a fire arm cushion.
Figure 19:
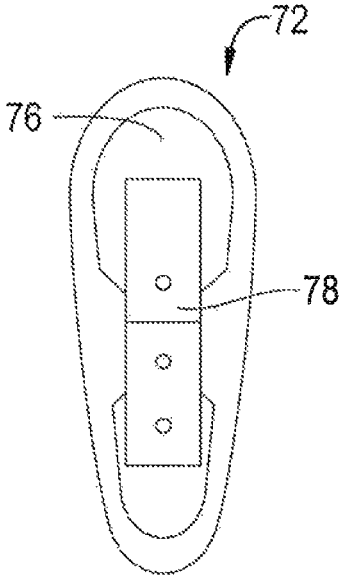
FIG. 19 shows a cut away rear view of a fire arm cushion.
Figure 20:
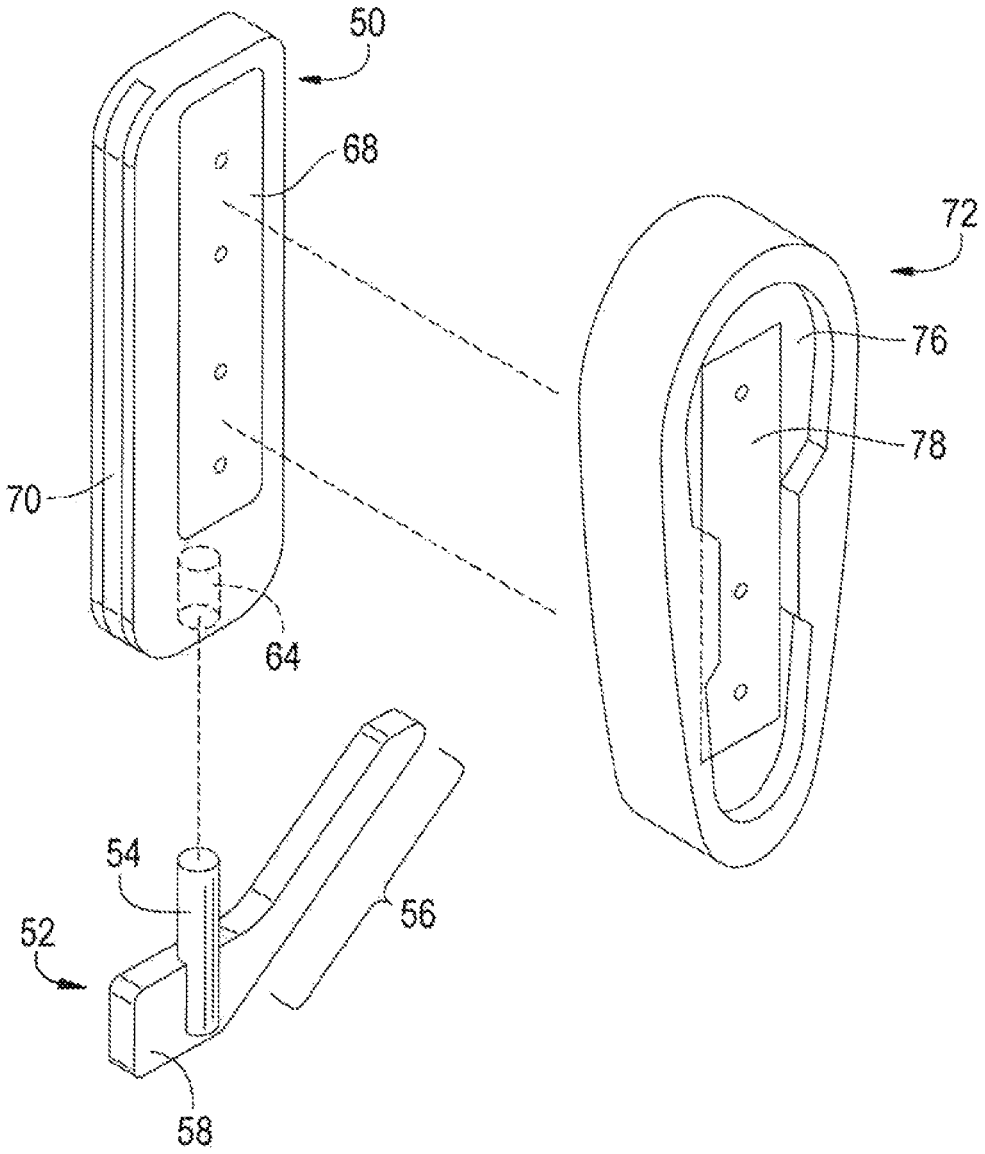
FIG. 20 shows a perspective view of the position of the fire arm cushion fire relative to the arm stabilization apparatus.

In this embodiment, the firearm stabilization apparatus 2 further comprises a firearm butt addition 72 as shown in FIGS. 18-20. The firearm butt addition 72 is attached to the butt of a firearm 74 and further comprises a cavity 67 configured to receive a third magnet 78. The firearm butt addition 72 can serve a multitude of purposes, including without limitation providing a cushion or padding between the operator and the firearm 74 to absorb recoil and to house the third magnet. In an alternate embodiment, the third magnet 78 can be added to the existing butt plate of a firearm 74 without the use of the firearm butt addition 72.

Figure 21:
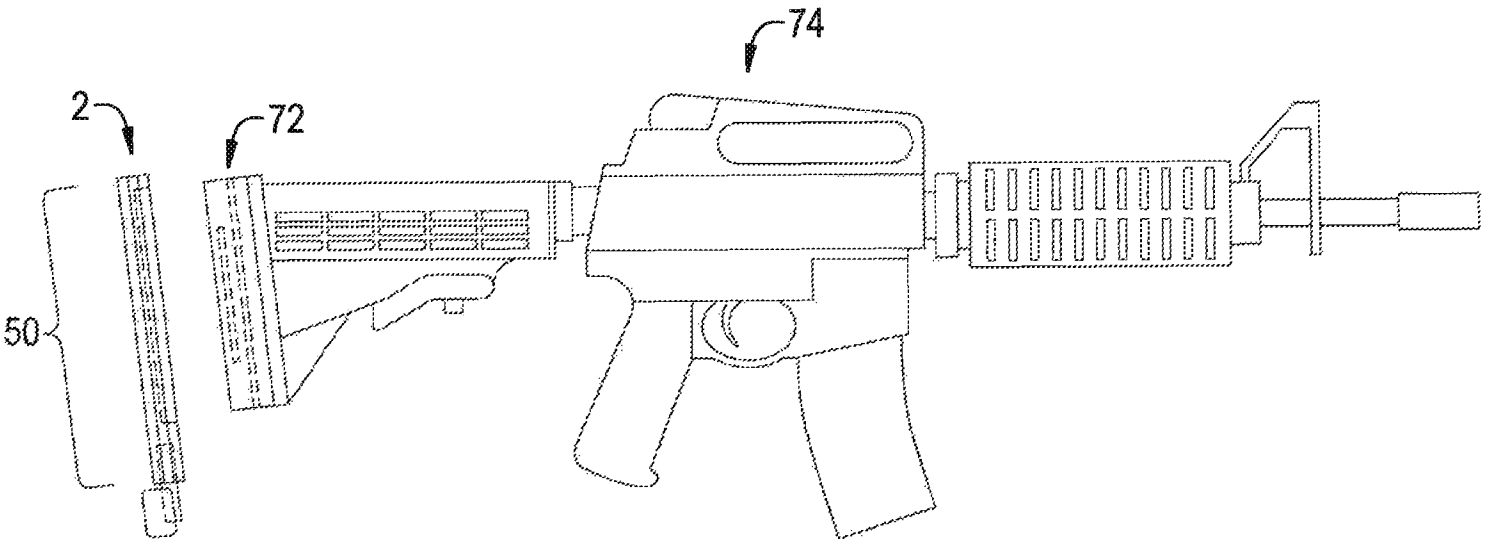
FIG. 21 shows a side view of the position of the fire arm comprising the fire arm cushion fire relative to the arm stabilization apparatus.

FIGS. 20-21 show use of this embodiment of the firearm stabilization apparatus 2. After the anchor is positioned in the pocket 48 of the body armor 34, the main body 50 is lowered onto the spindle 54. Next, the firearm 74 comprising the firearm butt addition 72 is brought into proximity to the main body 50, then the attractive forces of the first magnet 68 and the third magnet 78 serve to position the firearm 74 in the correct firing position (i.e., in the operator's shoulder pocket). The second magnet 70 serves to repel the third magnet 78 thereby adding additional force to keep the firearm 74 in the correct firing position. Further, since the main body 50 is rotatable on the spindle 54, the operator may rotate the firearm 74 as needed to accurately aim and shoot the firearm 74. In addition to helping position the firearm in the correct firing position, the firearm stabilization apparatus also helps alleviate the muscle strain and fatigue associated with holding the firearm 74 in the correct firing position for long periods of time.

While the invention has been described with respect to a limited number of embodiments, those skilled in the art, having benefit of this disclosure, will appreciate that other embodiments can be devised which do not depart from the scope of the invention as disclosed here.

We claim:

1. A firearm stabilization apparatus comprising:
   a. an anchor, said anchor further comprising:
      i. an anchor body,
      ii. a spindle extending upwardly from the anchor body, and
      iii. an arm extending from the anchor body, wherein the arm and the anchor body are integrally formed;
   b. a main body; said main body further comprising:
      i. a recess on a front face;
      ii. a first magnet positioned in the recess;
      iii. a slot on a first edge of the main body;
      iv. a second magnet positioned in the slot; and
      v. a spindle receiving element, wherein the spindle receiving element is configured to engage the spindle of the anchor; and
   c. a firearm, wherein said firearm further comprising a butt stock, wherein the butt stock further comprises a third magnet.

2. The apparatus of claim 1 wherein the main body is freely rotatable about the spindle.

3. The apparatus of claim 1 wherein the main body is configured to be placed within a pocket of a body armor.

4. The apparatus of claim 1 wherein the first magnet and the third magnet exhibit attractive forces towards one another.

5. The apparatus of claim 4 wherein the second magnet exhibits repulsive forces towards the third magnet.

6. The apparatus of claim 1 wherein the first magnet and the second magnet are held in the recess and the slot respectively at least in part by attractive forces between edges of the magnet.

7. The apparatus of claim 1 wherein the main body is a rectangle with rounded edges.

* * * * *